United States Patent [19]

Henych et al.

[11] Patent Number: 4,655,273

[45] Date of Patent: Apr. 7, 1987

[54] PROCESS OF AND INGOT MOULD CASTING ARRANGEMENT FOR CASTING A MELT

[75] Inventors: Ivo Henych; Rudolf Pavlovsky, both of Schaffhausen, Switzerland

[73] Assignee: Georg Fischer Aktiengesellschaft, Schaffhausen, Switzerland

[21] Appl. No.: 762,554

[22] Filed: Aug. 5, 1985

[30] Foreign Application Priority Data

Aug. 8, 1984 [CH] Switzerland ..... 3810/84

[51] Int. Cl.[4] ..... B22D 5/00; B22D 29/00

[52] U.S. Cl. ..... 164/323; 164/343; 164/344; 164/404

[58] Field of Search ..... 164/129, 130, 131, 136, 164/137, 269, 322, 323, 324, 339, 341, 342, 344, 404, 343

[56] References Cited

U.S. PATENT DOCUMENTS

| | | | |
|---|---|---|---|
| 1,925,497 | 9/1933 | Shippy | 164/344 |
| 2,976,586 | 3/1961 | Griggs | 164/130 |
| 3,262,164 | 7/1966 | Meves | 164/341 |
| 3,268,961 | 8/1966 | Clark | 164/344 |
| 3,370,640 | 2/1968 | Fenzan | 164/136 |
| 3,434,528 | 3/1969 | McGeeney | 164/339 |

FOREIGN PATENT DOCUMENTS

| | | | |
|---|---|---|---|
| 549247 | 5/1977 | U.S.S.R. | 164/130 |

*Primary Examiner*—Nicholas P. Godici
*Assistant Examiner*—Richard K. Seidel
*Attorney, Agent, or Firm*—Toren, McGeady and Goldberg

[57] ABSTRACT

In an ingot mould casting device for casting a melt, the ingot moulds (1, 1*a*, 1*b*) of the individual ingot mould units (35, 36, 37) are movable in a U-shaped clamp (13), wherein at the free ends (43) of the U-shaped clamp (13) there is provided an ingot mould holding- and pulling-apart mechanism. With the aid of this ingot mould holding-and pulling-apart mechanism, the ingot moulds are opened so far, after casting has been effected in the casting position, until the resistance during pulling-apart of the ingot mould (1, 1*a*, 1*b*) drops to the resistance with respect to the shifting of the ingot mould half (1*b*) movable on the guide rods (2). In a second phase, the movable ingot mould half (1*b*) is moved completely away from the non-movable ingot mould half (1*a*). The discharged parts fall onto the conveyor belt (18). The entire operation from the actuation of the starting button (42) of an ingot mould arrangement can take place automatically. Thus it is advantageous to use suitable sensors for monitoring the entire casting procedure.

7 Claims, 11 Drawing Figures

PROCESS OF AND INGOT MOULD CASTING ARRANGEMENT FOR CASTING A MELT

SUMMARY OF THE INVENTION

The present invention is directed to an ingot mould casting arrangement, whereby individual ingot moulds are placed into the casting position.

The advantages of ingot mould casting in box- and sandless casting of castings of exact size with a high yield and minimal cleaning costs are known. The concept of known ingot mould foundries is substantially based on the use of carousel ingot mould casting machines for a limited assortment, or of universal ingot mould casting machines for a wide assortment of castings. When designing such a casting arrangement, one proceeds from the fact that a casting furnace supplies one, and at the most two, ingot mould casting machines arranged on both sides, with molten iron. This complicates the handling of the red discharged parts which have to be brought quickly from the respective individual ingot mould casting machines into a furnace for temperature equalization. The effectiveness of the expensive universal ingot mould casting machines is only rarely fully achieved.

A modern ingot mould foundry should have the following features with regard to minimal ihvestment, high output and good handling:

1. Supplying several ingot mould casting machines from a single casting furnace.
2. According to the shape of the castings it should be possible to cast the ingot moulds according to their parting in the vertical or horizontal position.
3. The parts discharged basically vertically to the ingot mould parting should be conveyable by means of a common conveyor belt through a transport tunnel along the shortest path to the common temperature-equalization furnace.
4. Increase in output by several superimposed ingot moulds (billet), two billet arrangements if possible, whereby the simultaneous casting of the billets takes place with respectively a controllable casting plug.
5. A simplified ingot mould casting machine corresponding to points 1 to 4. At the same time this is also the air of the present invention.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
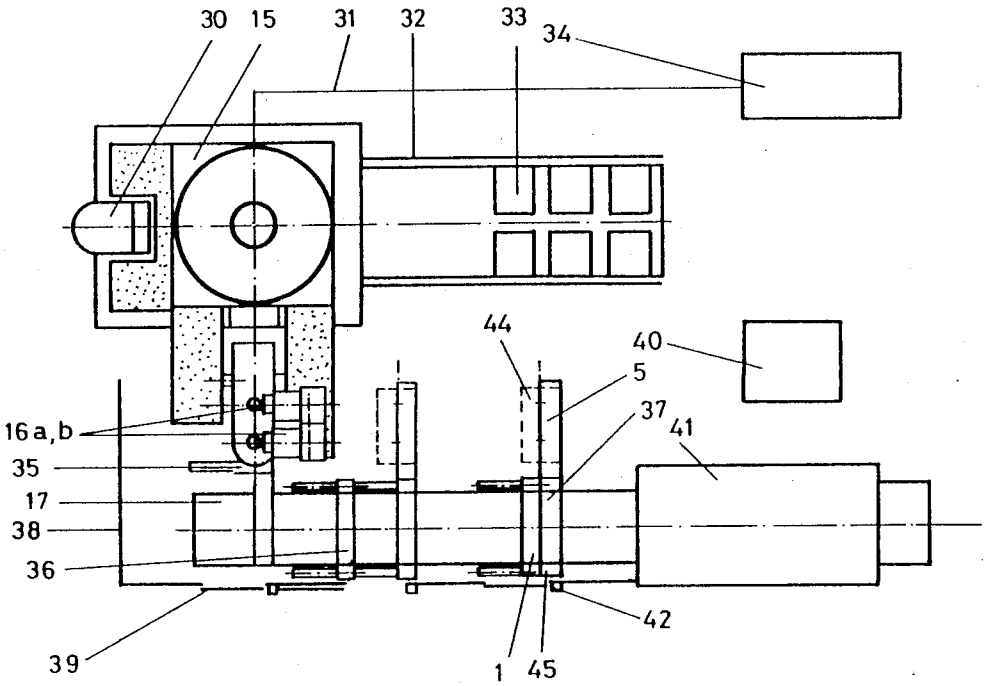
FIG. 1 is a plan view of an ingot mould arrangement according to the invention.
Figure 2:
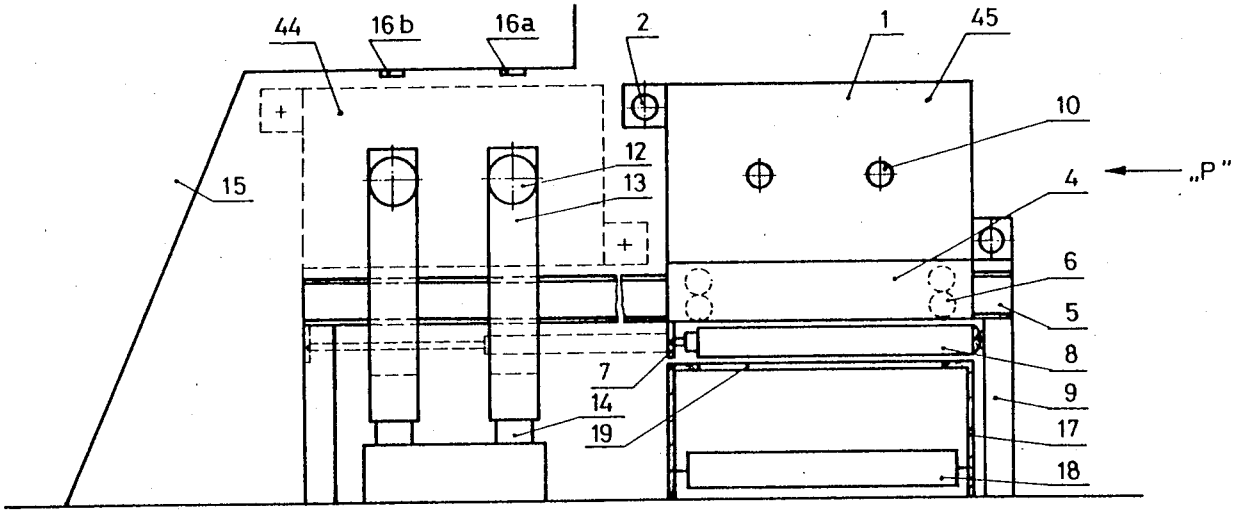
FIG. 2 is an ingot mould unit with an ingot mould before moving away into the casting position.
Figure 3:
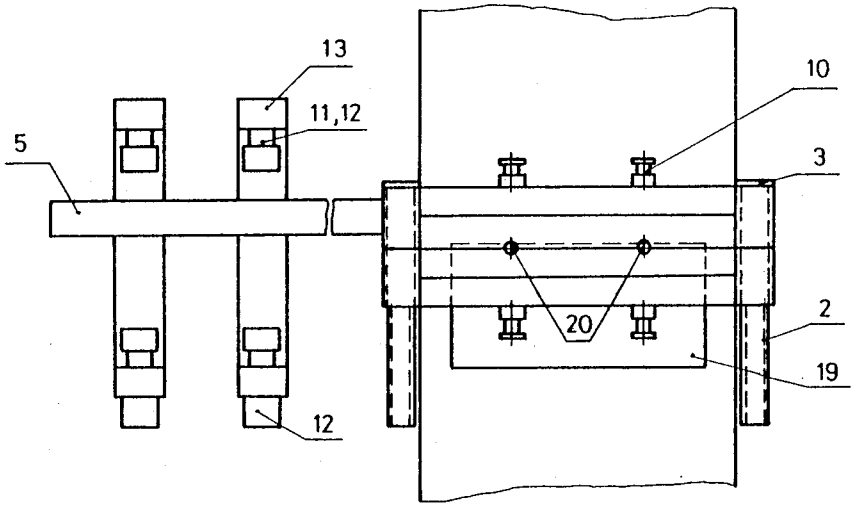
FIG. 3 is a plan view of FIG. 2.
Figure 4:
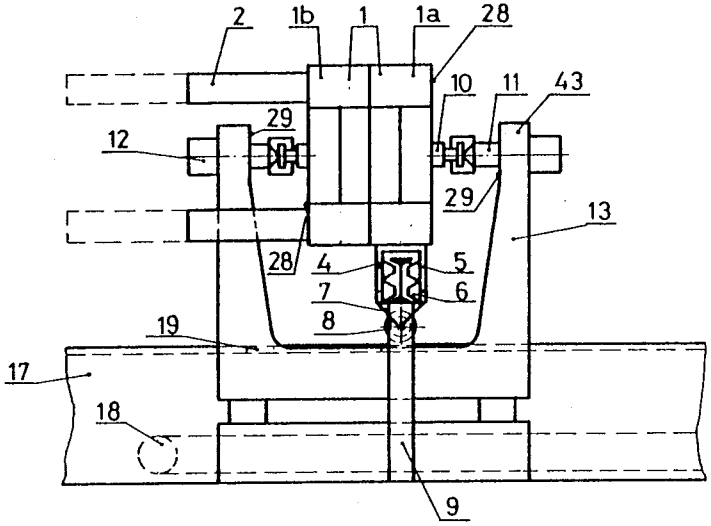
FIG. 4 is a view taken in the direction of the arrow P in FIG. 2, with the ingot mould in the casting position.
Figure 5:
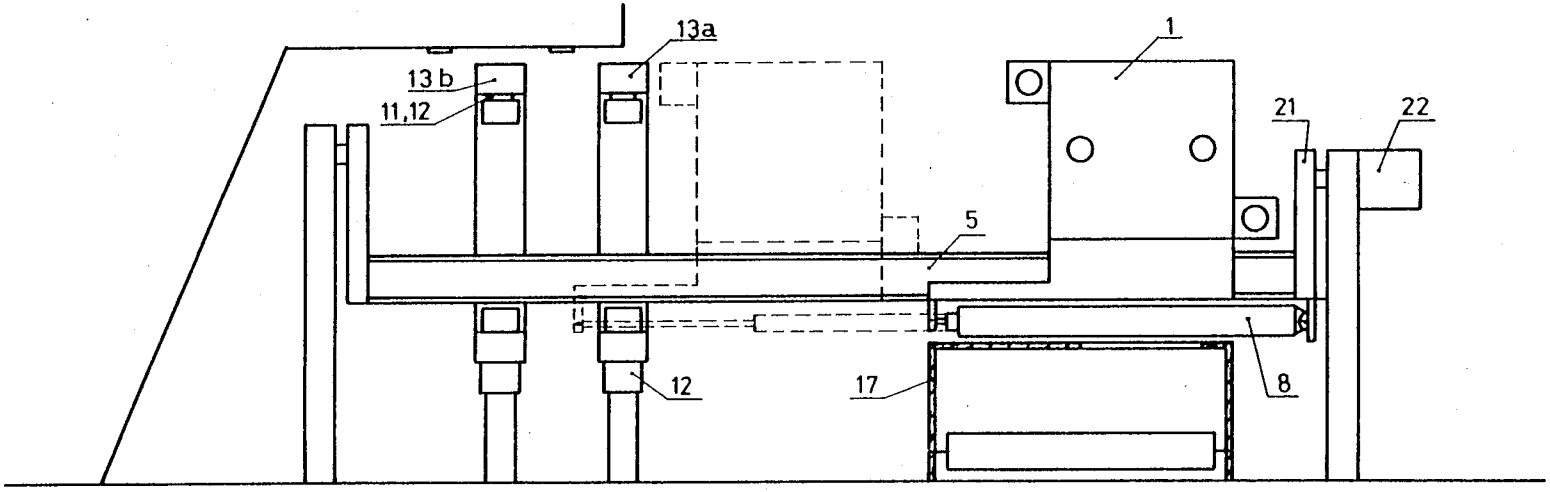
FIG. 5 is an ingot mould unit with an ingot mould with horizontal ingot mould parting before moving away into the casting position.
Figure 6:
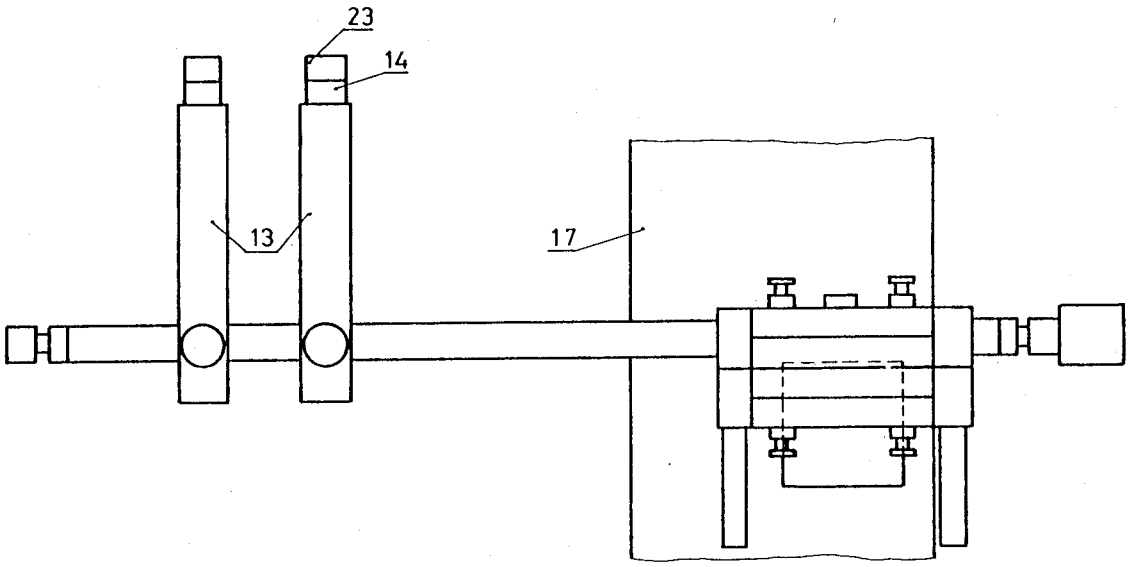
FIG. 6 is a plan view of FIG. 5.

FIG. 1 shows an ingot mould arrangement with a casting furnace 15 which has a filling aperture 30. The casting furnace 15 moves on the rails 32 along the three spaced ingot moulds 35 to 37. Associated with the casting furnace 15 is a switchbox 34, cable and cooling water lines 31 and a pig bed 33. The ingot mould units 35, 36, 37 are moved along the guideways 5 into the casting positions 44. The ingot mould unit 35 is cast by means of two casting plugs **16*a*, 16*b*. The ingot mould unit 37 is ready for casting and the ingot mould unit 36 is regulated and cleaned after discharging of the castings. In starting position 45, cores or metallic parts may also be inserted and both halves of the ingot mould are treated. The discharged parts fall onto a conveyor belt 18 (FIG. 2) in the transport channel 17 and reach the temperature equalization furnace 41 along the shortest path. For reasons of safety the ingot mould units are surrounded by walls 38 and doors 39. A common hydraulic unit 40** is provided.

The arrangement described in FIG. 1 presupposes substantial simplifications in the ingot mould casting machines, as are shown in the following FIGS. 2 to 11.

The ingot mould casting machines comprise substantially the ingot mould plates **1*a*, 1*b* with the ingot mould halves, which are provided with two guide rods 2 with inner built-in cylinders 3. The non-displaceable ingot mould plate 1*a* has a holding means 4 with 2×4 rollers 6. These rollers guide the complete ingot mould on a guideway 5. The telescopic cylinder 8 which abuts the crosspiece 9 and the support 7 takes care of the movement of the ingot mould 1 into the casting position 44. The cylinders 3 in the guide rods 2 constructed as tubes are only used for the complete opening of the two ingot mould plates 1*a*, 1*b* which were previously separated from one another, and in order to close them again completely before moving-away into the casting position 44**.

Figures 9, 10, 11:
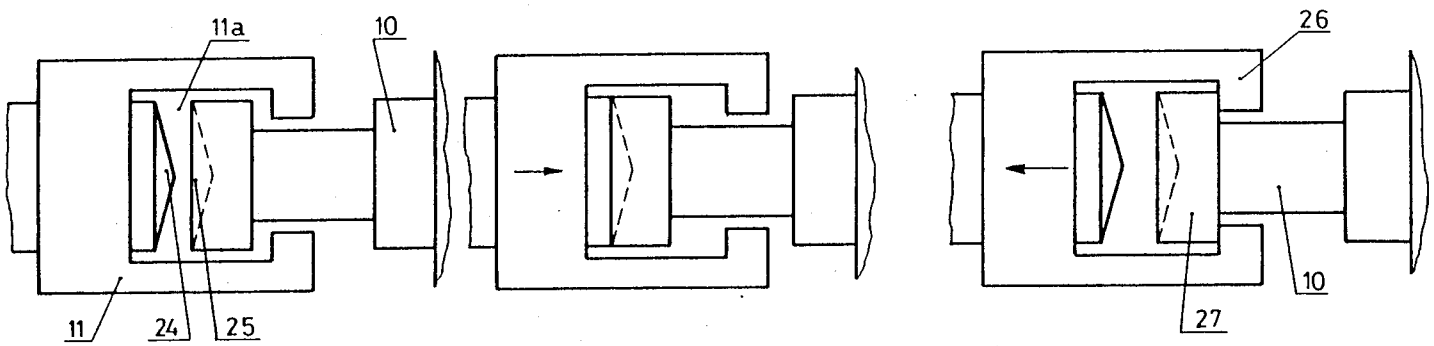
FIGS. 9–11 are detailed views of the ingot mould holding-and pulling-apart mechanism.

Two U-shaped clamps 13 in the casting position 44 are arranged in parallel and perpendicularly to the guideway 5 and each has at its free ends 43 and on the inner walls 29 a piston rod 11 with a recess **11*a*, note FIG. 9. These are intended to come into engagement with the journals 10 which are arranged on the outer surfaces 28 of the ingot mould plates 1*a*, 1*b*. Also the guideway 5 is fitted inside the U-shaped clamps 13. The clamps 13 are resiliently secured on silent blocks 14**.

The whole forms an ingot mould unit.

The method of operation is as follows:

The ingot mould 1 which has been placed into the casting position 44 moves with the four journals 10 onto the recesses **11*a* of the piston rods 11 of the cylinders 12 (FIG. 9). The two halves of the ingot mould 1*a*, 1*b* are pressed together by moving the piston rods 11 with their conical ends 24 into the recesses 25 of the journals 10 (FIG. 10). The U-shaped clamps 13** pick-up the occurring reactions.

After pouring from the two casting plugs **16*a*, 16*b* into the filling apertures 20, the ingot mould 1 is first of all held with a locking force of the cylinders 12. Then the cylinders 12 are reversed. The piston rods 11 move into the position according to FIG. 11. Thus the piston rods 11 with their lugs 26 have an effect on the collars 27 of the journals 10. As soon as all the lugs 26 abut the collars 27, the pressure in the cylinders 12 begins to increase. After reaching a specific pressure of e.g. 5 bar, at least the pressure side of the cylinder 12 is blocked on the side of the non-displaceable ingot mould plate 1***a*, so that the displaceable ingot mould plate 1*b* can be pulled apart from the non-displaceable ingot mould plate 1*a* without damaging the guideway 5 and is moved by about 20 mm.

After this the telescopic cylinder 8 withdraws the ingot mould 1 into its original position 45, with the cylinders 12 under no pressure. With the aid of the cylinder 3 the ingot mould 1 is then fully opened. At the same time as the opening procedure, ejectors (not shown) are activated. The discharged parts fall through the aperture 19 onto the conveyor belt 18 in the transport channel 17.

Figure 7:
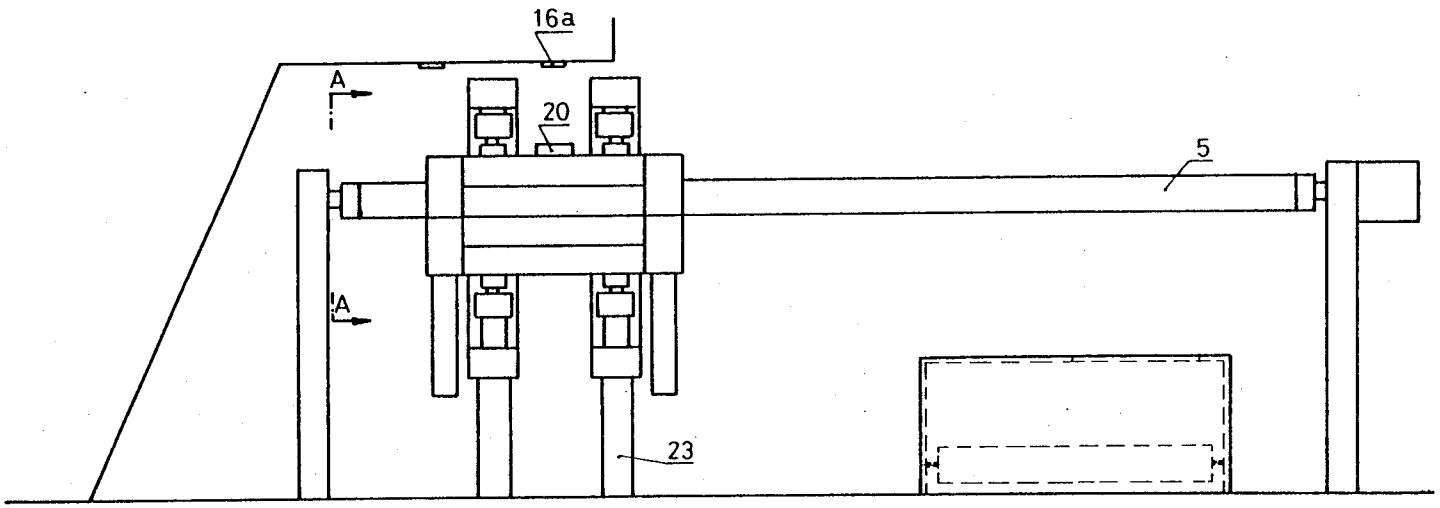
FIG. 7 is an ingot mould unit with an ingot mould with horizontal mould parting in the casting position.
Figure 8:
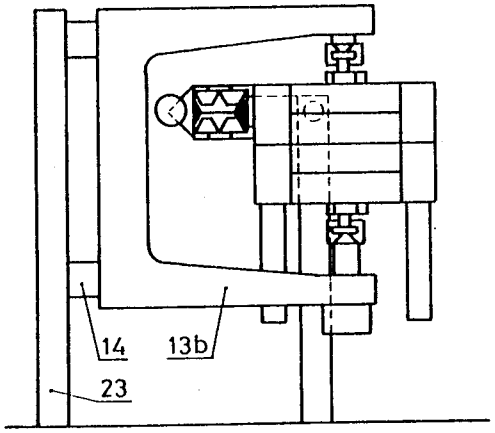
FIG. 8 is a view A—A from FIG. 7.

In the case of ingot moulds which have to be cast with the parting plane in the horizontal position, the telescopic cylinder 8 moves the closed ingot mould 1 into the area between the transport channel 17 and the clamp 13*a*. (Shown in FIG. 5 in dot-dash line). Here the ingot mould 1 is swivelled by 90° by means of a pivot drive 22 with the aid of a rocker 21, and then moved into the casting position 44 with the telescopic cylinder 8 between the two clamps 13*a*, 13*b*. The further operation takes place according to the above description. The ingot mould 1 with the filling aperture 20 is cast by means of a casting plug 16*a* (FIG. 7). The parts discharged in the original position 45 fall through the recess 19 in the transport channel 17 onto the conveyor belt 18.

The clamps 13 are held with the crosspieces 23.

The original positions 45 are selected according to the conveyor belt 18 so that all the castings reach the temperature equalization furnace 41.

The whole operation, beginning with the closing of the doors 39 and the actuating of the starting button 42 of an ingot mould unit (FIG. 1) can be effected automatically up to the discharging of the parts. It is advantageous to use suitable sensors for monitoring the entire casting process.

While specific embodiments of the invention have been shown and described in detail to illustrate the application of the inventive principles, it will be understood that the invention may be embodied otherwise without departing from such principles.

We claim:

1. Ingot mould casting device for casting a melt in an ingot mould comprising several ingot mould units, a casting furnace, and means for transporting said furnace in a first direction, the improvement comprising:

each said ingot mould unit comprising ingot moulds with a stationary ingot mould plate and a movable ingot mould plate;

means for moving each said ingot mould unit from a starting position to a casting position transverse to said first direction on a guideway; and an upright U-shaped clamp located at said casting position, said clamp having a pair of upstanding legs with a free end at the upper end of each said leg, and at least one ingot mould holding-and-pulling-apart mechanism located at the free ends of said clamp, wherein said mechanism interengages said mould plates for opening and closing said mould.

2. Ingot mould casting device, as set forth in claim 1, wherein said ingot mould halves (1*a*, 1*b*) include outer walls (28), said ingot mould holding-and pulling-apart mechanism comprising journals (10) arranged on both sides of said outer walls of said ingot mould halves, said U-shaped clamp having inner walls (29), a piston rod (11) and cylinder (12) unit arranged on the inner walls of said clamp so that said journals (10) can be inserted into said piston rods (11) in the travel direction of the ingot mould (1) on said guideway (5).

3. Ingot mould casting device, as set forth in claim 1, wherein said U-shaped clamp (13) is resiliently mounted.

4. Ingot mould casting device, as set forth in claim 1, wherein two said U-shaped clamps (13) in parallel spaced relation are located in the casting position and are resiliently mounted.

5. Ingot mould casting device, as set forth in claim 1, wherein a rocker (21) supports said guideway (5) so that said guideway and said ingot mould can be swivelled through 90°.

6. Ingot mould casting device, as set forth in claim 1, wherein ingots are discharged at the starting position, and a conveyor belt (18) is positioned under the ingot moulds (1) to receive said discharged ingots.

7. Ingot mould casting device, as set forth in claim 6, wherein guide rods (2) are provided for said movable ingot mould half (1*b*), and cylinders (3) arranged in the guide rods (2) for moving-apart and guiding the displaceable ingot mould half (1*b*).

* * * * *